US010472148B2

(12) United States Patent
Tribbett

(10) Patent No.: US 10,472,148 B2
(45) Date of Patent: Nov. 12, 2019

(54) COUPLING ARTICLE

(71) Applicant: Stephen LaMont Tribbett, Dallas, TX (US)

(72) Inventor: Stephen LaMont Tribbett, Dallas, TX (US)

( * ) Notice: Subject to any disclaimer, the term of this patent is extended or adjusted under 35 U.S.C. 154(b) by 0 days.

(21) Appl. No.: 15/442,701

(22) Filed: Feb. 26, 2017

(65) Prior Publication Data

US 2017/0247153 A1 Aug. 31, 2017

Related U.S. Application Data

(60) Provisional application No. 62/300,759, filed on Feb. 26, 2016.

(51) Int. Cl.

| | |
|---|---|
| ***B65D 63/16*** | (2006.01) |
| ***B65D 63/10*** | (2006.01) |
| ***B65D 63/08*** | (2006.01) |
| *B65D 63/06* | (2006.01) |

(52) U.S. Cl.

CPC ..... *B65D 63/16* (2013.01); *B65D 63/08* (2013.01); *B65D 63/109* (2013.01); *Y10T 24/1404* (2015.01); *Y10T 24/3916* (2015.01)

(58) Field of Classification Search

CPC ..... B65D 63/16; B65D 63/109; B65D 63/06; B65D 63/00; B65D 57/00; Y10T 24/14; Y10T 24/3916; Y10T 24/4047; Y10T 24/4002; Y10T 24/4093; Y10T 24/4773; Y10T 24/3703; Y10T 24/1404

USPC ..... D7/633

See application file for complete search history.

(56) References Cited

U.S. PATENT DOCUMENTS

| | | | | | |
|---|---|---|---|---|---|
| 479,509 | A | * | 7/1892 | Heaphy | F16G 11/10 24/129 A |
| 1,132,571 | A | * | 3/1915 | Forsgard | B65D 63/14 24/129 A |
| 1,735,691 | A | * | 11/1929 | Lawler | B65D 63/14 24/128 |
| 2,212,862 | A | * | 8/1940 | Hirsh | A44B 11/04 2/268 |

(Continued)

*Primary Examiner* — Robert Sandy
*Assistant Examiner* — Michael S Lee

(57) ABSTRACT

An article for coupling bands, cords, straps and the like to bundle items. The coupling article comprises a body having at least two end sections each having a cutout and passage means formed therethrough to removably retain a portion of a tensile line. A user may use an end section of the coupling article to engage a first portion of a closed-loop tensile line, encircle one or more objects, and engage a remaining portion of the closed-loop tensile line with an opposing end section, thus holding the objects together. A user may also secure objects using the coupling article in combination with an open-loop tensile line by wrapping the tensile line around a first end section, within the cutout and securing with a knot. With the remaining open-loop tensile line, the user would encircle one or more objects, and then wrap the open-loop tensile line around a second end section, within the cutout and secure with a knot. The coupling article may be constructed of plastic, metal, or other rigid material to meet the needs of the application. The dimensions of the coupling article may be of varying size depending on the desired compressive force needed on the objects, and the size and strength of the tensile line.

11 Claims, 4 Drawing Sheets

(56) References Cited

U.S. PATENT DOCUMENTS

| | | | | | |
|---|---|---|---|---|---|
| 2,229,003 | A * | 1/1941 | Fly | A44B 11/04 | 24/200 |
| 2,967,340 | A * | 1/1961 | Pernecky, Jr. | A45C 13/40 | 2/150 |
| 3,447,208 | A * | 6/1969 | Beach | B65D 63/16 | 24/23 B |
| 4,148,113 | A * | 4/1979 | Dvorachek | F16L 3/223 | 24/16 R |
| 4,639,977 | A | 2/1987 | Howard | | |
| 4,648,159 | A * | 3/1987 | Dougherty | A41F 1/04 | 24/129 R |
| 5,027,478 | A | 7/1991 | Suhr | | |
| 5,199,135 | A | 4/1993 | Gold | | |
| 5,626,436 | A | 5/1997 | Dragone | | |
| D390,066 | S * | 2/1998 | Watkins | D7/633 | |
| 5,774,945 | A * | 7/1998 | Ginocchio | B65D 63/14 | 24/130 |
| 5,915,629 | A | 6/1999 | Ribeiro | | |
| 6,842,948 | B2 | 1/2005 | Smith | | |
| D568,723 | S * | 5/2008 | Morgan | D8/356 | |
| D618,985 | S * | 7/2010 | Sjoqvist | D8/356 | |
| D666,939 | S * | 9/2012 | Dunn | D11/184 | |
| D727,717 | S * | 4/2015 | Byrne | D8/356 | |
| 9,791,102 | B2 * | 10/2017 | Moreau | A44C 11/005 | |
| 2002/0013983 | A1 * | 2/2002 | Choe | A43C 7/00 | 24/712.9 |
| 2006/0190041 | A1 * | 8/2006 | Fallin | A61B 17/0401 | 606/232 |
| 2009/0075562 | A1 * | 3/2009 | Lung | A41C 3/0071 | 450/58 |
| 2011/0126382 | A1 * | 6/2011 | Kirkham | A61B 17/1322 | 24/16 R |
| 2015/0224009 | A1 * | 8/2015 | Cedrone | F16M 13/04 | 128/845 |
| 2017/0049188 | A1 * | 2/2017 | Shirley | A43B 23/26 | |

* cited by examiner

FIG. 1A
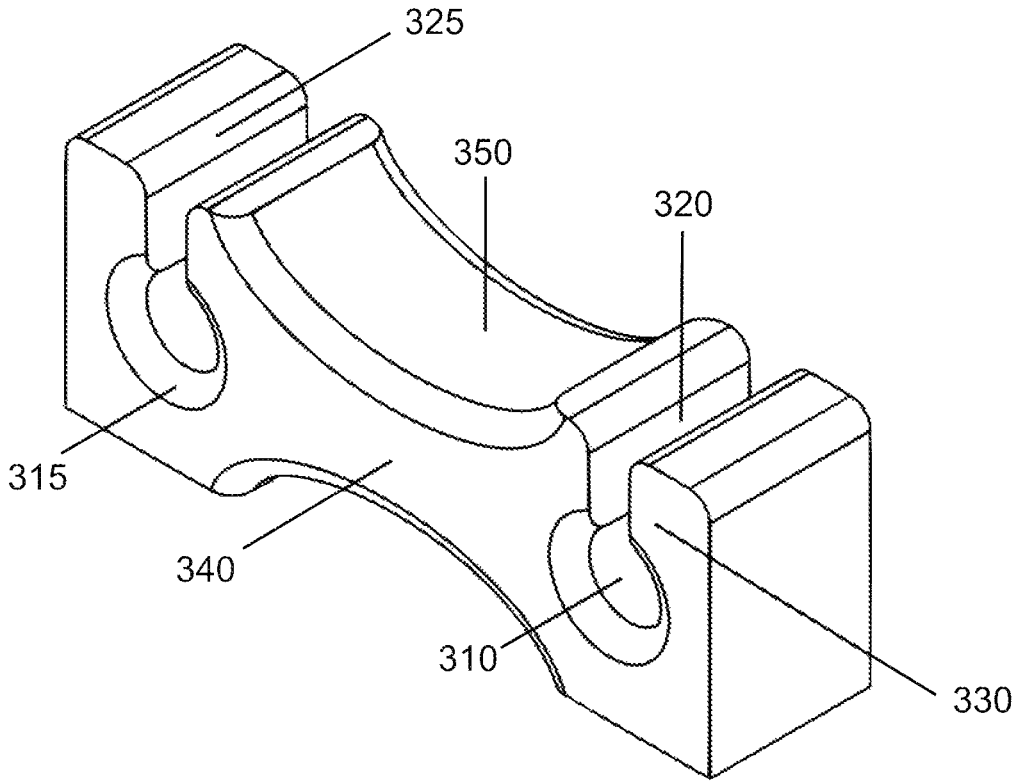
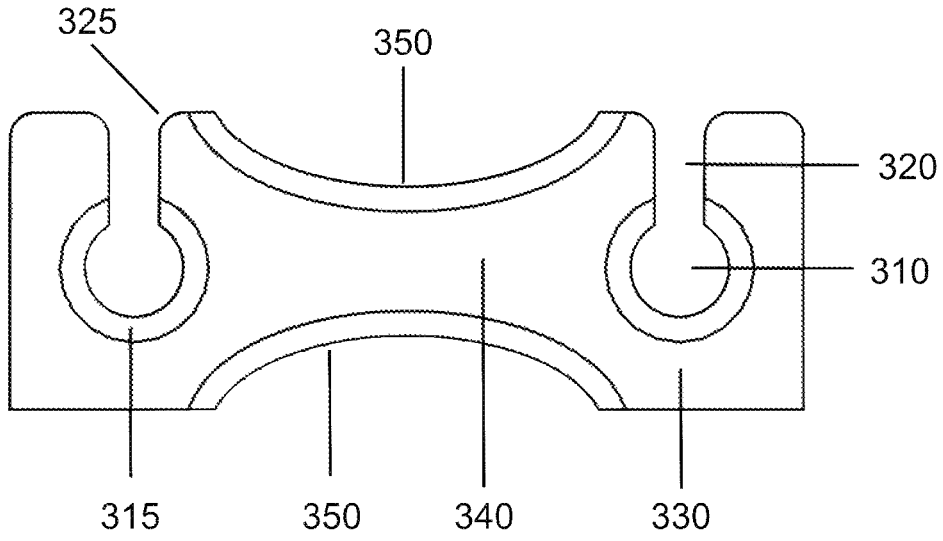
FIG. 1B

FIG. 4A
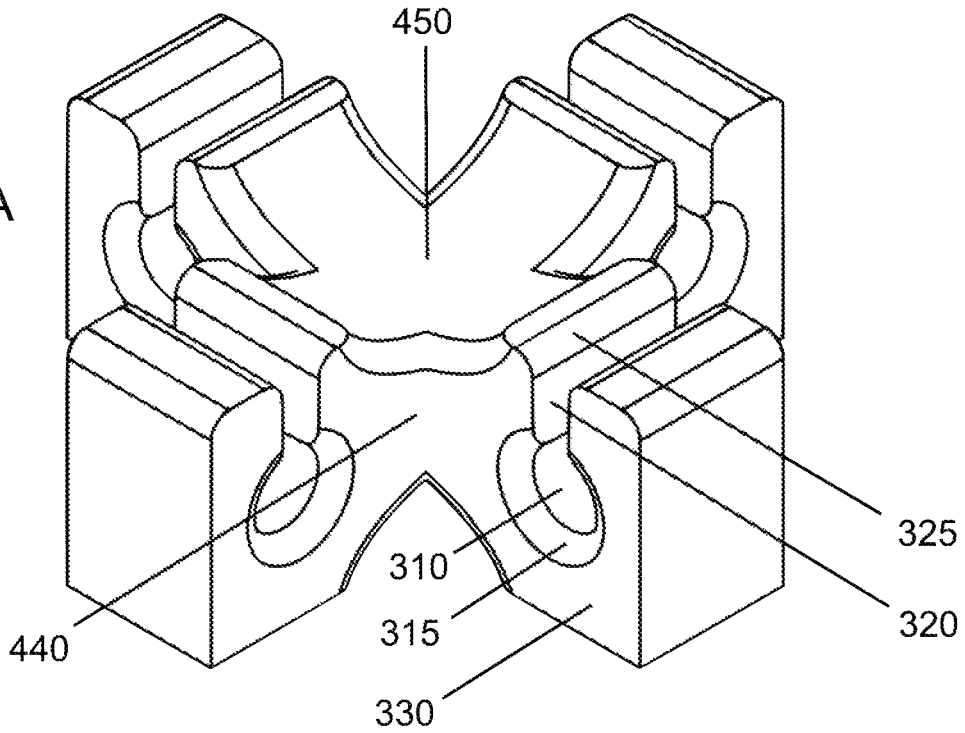
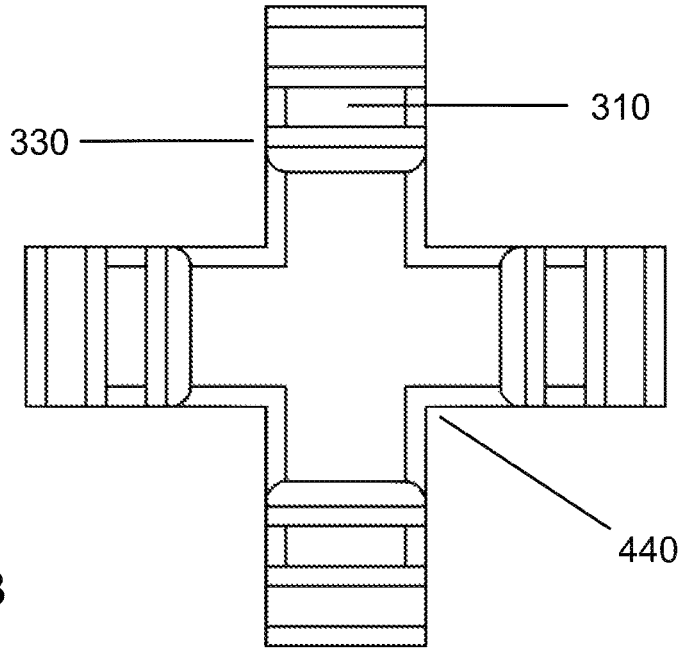
FIG. 4B

COUPLING ARTICLE

CROSS-REFERENCE TO RELATED APPLICATIONS

This application claims the benefit of provisional patent application Ser. No. 62/300,759, filed 2016 Feb. 26 by the present inventor.

BACKGROUND

Cords, cables, straps and bands have long been employed in conjunction with fastening devices to bundle or otherwise organize one or more objects such as computer cables, power tool cords, building materials, automotive parts and jumper cables. These devices include various types of closers, clasps, clamps, hooks and combination binders. Combination binders generally employ a closed-loop band and a retaining dowel, or an open-loop strap and a buckle. One popular type of combination binder includes a closed-loop band that is wrapped around a bundle and through itself with a dowel holding the ends of the band. The dowel of this type of combination device may protrude possibly causing a snag and damage nearby items as well as dislodge the dowel out of the band. Other combination binders in this category have slots in the dowel to improve band retention but are used with a specific sized band and thus do not typically accommodate bands of varying size. These combination binders and other fastening devices offer limited functionality, are complex in design, and therefore have less appeal to the average consumer. Thus, there is a need for an inexpensive, versatile, and easy to use fastener that can securely hold items of various shapes, sizes and weights together.

One fastener aimed at having these benefits is shown in U.S. Pat. No. 7,856,698 to Hays (2010) where the fastener is generally shaped like the letter "H" with two end pieces connected by a single crossbar or a similar cross-connected structure. In use, a continuous length of cord or elastic may be looped around one of the uprights of the "H," wrapped around a bundle of items, and then looped around the other upright of the "H," thus holding the items together. Although the design Hays employs is relatively simple, to secure a band it is necessary to pull a first loop end of the band over the corners of the first end piece of the fastener, and while maintaining tension on the band, pull a second loop end of the band over the corners of the second end piece of the fastener. This process involves multiple steps that some may find awkward and time consuming. The design also lends itself to the band slipping off the end piece, the correction for which Hays includes a small raised cylindrical post fixedly attached to each end piece appendage. However, the cylindrical post is not a good solution since the fastener and band could easily be moved out of place during normal handling causing the band to slip under the post or an end piece to hop over the band resulting in the security of the bundled items being compromised.

In conclusion, insofar as I am aware, no fastener formerly developed is simple in design, simple in use, and securely couples open-loop bands, closed-loop bands and cords.

SUMMARY

For improved readability, the term "tensile line" is used throughout the following summary, description and claims, and is generally defined to include bands, cords, cables, straps and other similar items having either elastic or inelastic properties.

An easy to manufacture and easy to use bundling solution is provided by a coupling article comprising a body conjoining at least two end sections. The coupling article, in conjunction with a closed-loop or open-loop tensile line, securely fastens bundled items.

Each end section, having a cutout and a contiguous passage means formed therethrough, is configured to releasably engage a portion of a closed-loop tensile line by sliding the portion through the passage means, and then into the cutout. To secure one or more objects, the user engages a portion of the closed-loop tensile line with a first end section of the coupling article, wraps the closed-loop tensile line around the objects one or more times, and then engages the remaining portion of the closed-loop tensile line with a second end section of the coupling article.

Each end section, having a cutout and a contiguous passage means formed therethrough, is configured to secure a portion of an open-loop tensile line by wrapping the portion around the end section, within the cutout and tying with a knot. To secure one or more objects, the user secures a portion of the open-loop tensile line with a first end section of the coupling article, wraps the open-loop tensile line around the objects one or more times, and secures the remaining portion of the open-loop tensile line with a second end section of the coupling article.

Accordingly, several advantages of the coupling article are its unitary construction, user friendliness, secured coupling ability, the ease of coupling extra tensile lines to increase the holding tension around the bundled items. These and other objects, advantages and features will be more fully understood and appreciated by reference to the written specification and appended drawings.

BRIEF DESCRIPTION OF THE DRAWINGS

For a detailed description of exemplary embodiments of the invention, reference is now made to the figures of the accompanying drawings. The figures are not necessarily to scale, and certain features and certain views of the figures may be shown exaggerated in scale or in schematic form, and some details of conventional elements may not be shown in the interest of clarity and conciseness.

FIG. 1A is a perspective view of an embodiment of a coupling article in accordance with principles disclosed herein;

FIG. 1B is an elevation view of the coupling article depicted in FIG. 1A in accordance with principles disclosed herein;

FIG. 4A is a perspective view of another embodiment of a coupling article having four end sections in accordance with principles disclosed herein;

FIG. 4B is a plan view of the coupling article depicted in FIG. 4A in accordance with principles disclosed herein;

NOTATION AND NOMENCLATURE

Figure 2A:
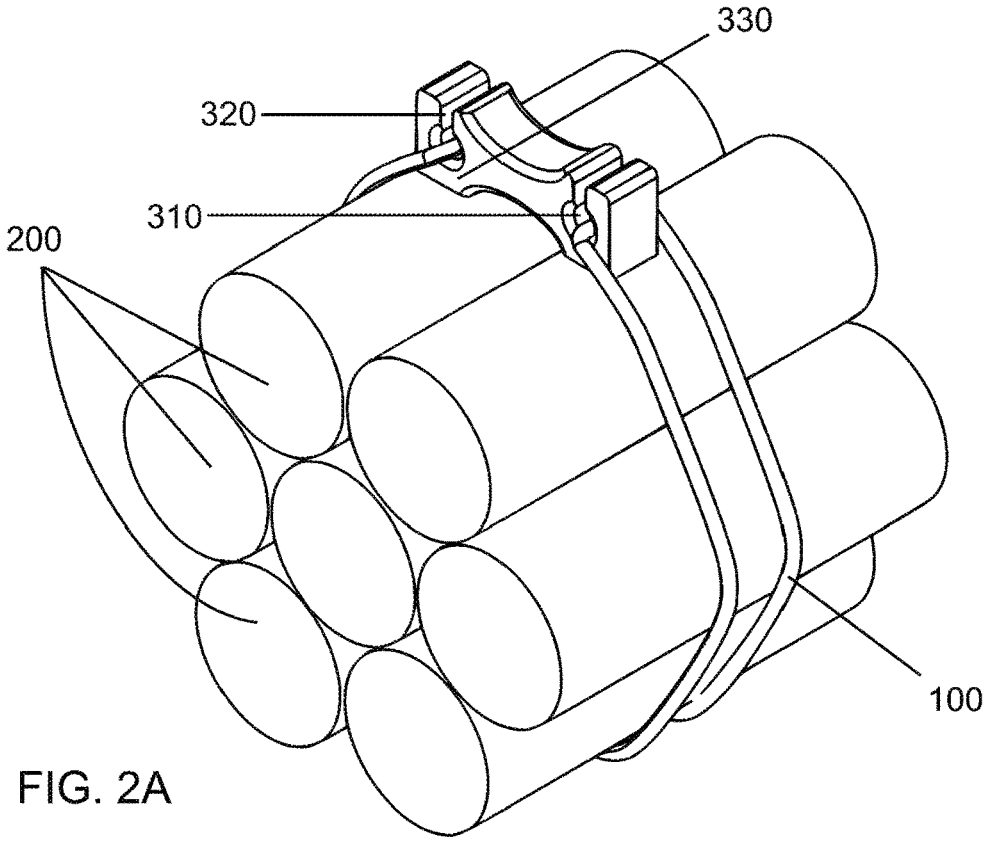
FIG. 2A is a perspective view of the embodiment depicted in FIG. 1A in combination with a closed-loop tensile line and objects in accordance with principles disclosed herein.

Certain terms are used throughout the following description and claims to refer to particular article components. In the following discussion and in the claims, the terms "including" and "comprising" are used in an open-ended fashion, and thus should be interpreted to mean "including, but not limited to . . . ".

DETAILED DESCRIPTION

In the drawings and description that follow, like parts are typically marked throughout the specification and drawings with the same reference numerals. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings and components of the embodiments discussed below may be employed separately or in any suitable combination to produce desired results.

FIG. 1A and FIG. 1B are perspective and elevation views respectively of one embodiment of a coupling article. The coupling article comprises a pair of end sections 330 conjoined by body 340. Each end section 330 includes a cutout in the shape of bore 310 formed therethrough and located at the proximate center of end section 330. Each end section 330 also includes a passage means in the form of channel 320 formed therethrough that is contiguous to bore 310. The coupling article may have one or more sides with a concavity 350 to increase the flexibility of the coupling article allowing it to conform to the surface of the objects being bundled, giving it a lower profile, and to establish a greater contact area between the coupling article and the bundled objects. One or more sides can also have concavity 350 to conserve the amount of material used. Each outside corner 325 of the channel 320 may preferably be rounded to ease the passage of the tensile line into the channel 320. The edge 315 of bore 310 may also advantageously be rounded to give the tensile line a smooth surface over which to move. The channel 320 may be sized wide enough to accept, with some resistance, the tensile line while in a taut or stretched condition. This size will generally prevent the same tensile line, while in a relaxed condition, from exiting the bore 310 so that the coupling article keeps the tensile line engaged when not bundling objects. A benefit of the coupling article engaging the tensile line without objects is the coupling article can be easily stored with the tensile line when not bundling objects lessening the chance of misplacing the coupling article. The diameter of bore 310 may preferably be of a dimension to accommodate the retention of at least three tensile lines so that extra tensile lines may be added for increased binding security.

Figure 3A:
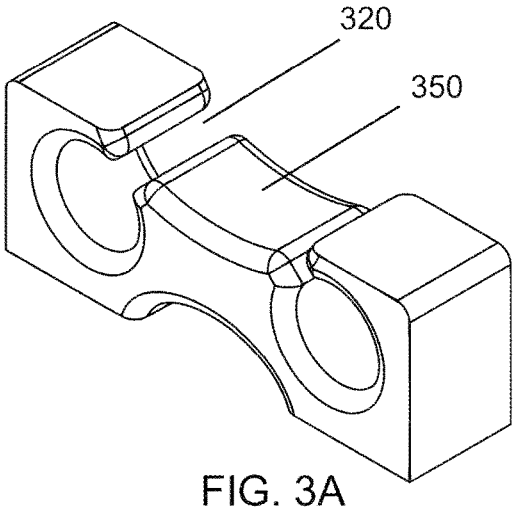
FIGS. 3A to 3D show perspective views of other embodiments of the coupling article having various cutouts and passage means of different shapes and locations in accordance with principles disclosed herein.
Figure 3B:
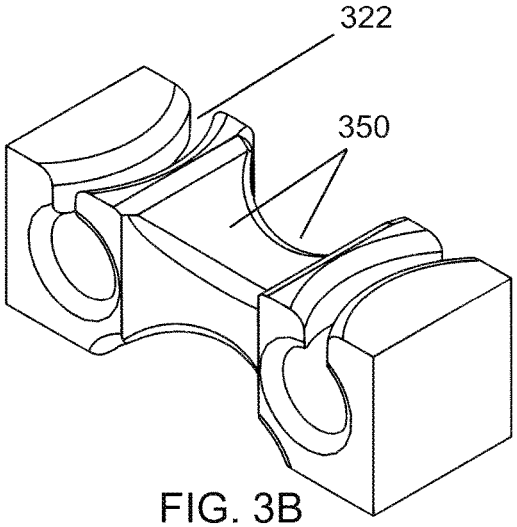
Figure 3C:
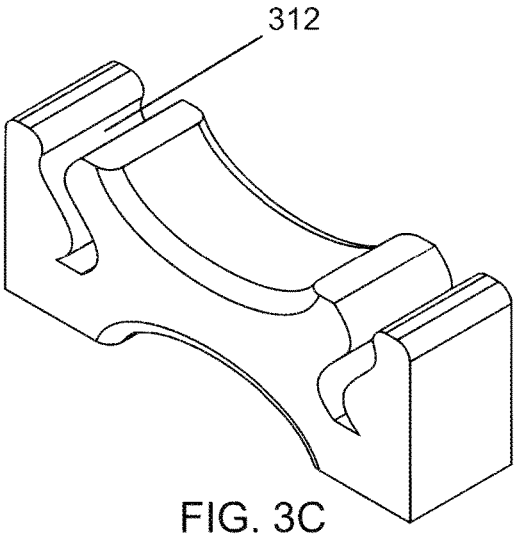
Figure 3D:
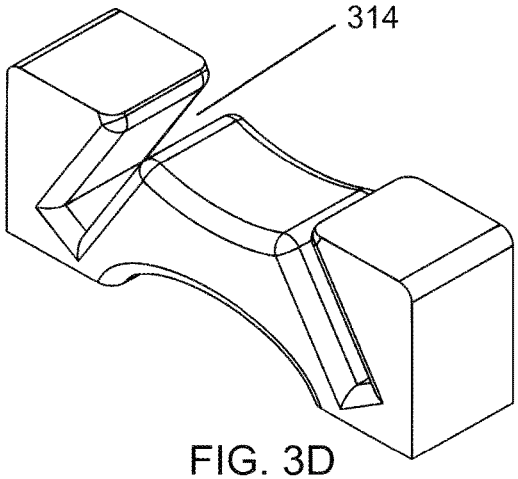

There are various possibilities with regard to the location and shape of the cutout, passage means and concavity, a few of which are illustrated in FIG. 3A to FIG. 3D. FIG. 3A shows an embodiment of the coupling article having a passage means in the form of channel 320 positioned within concavity 350. FIG. 3B shows an embodiment of the coupling article having a curved channel 322 and concavity 350 on four sides. FIG. 3C shows an embodiment in which the passage means and cutout are combined and take the form of an "S" shaped slot 312. Similarly, FIG. 3D illustrates another embodiment in which the passage means and cutout are combined and take the form of a straight slot 314.

FIG. 4A and FIG. 4B illustrate another embodiment of the coupling article having a body 440 connecting two pairs of end sections 330 allowing the items to be bundled in a crisscross like fashion.

The dimensions of the coupling article are scaled according to the proportion and tensile strength of the tensile line employed to suit the size and weight of the items to be bundled. That is, the coupling article may be manufactured in various sizes in addition to established standard sizes of small, medium and large. The coupling article may be constructed of plastic, metal, or other rigid material.

Operation

In the description that follows, although one embodiment of a component or element may be referenced in describing the different aspects of operation, it is intended that the steps described below also generally apply to the alternative embodiments disclosed herein.

Figure 2B:
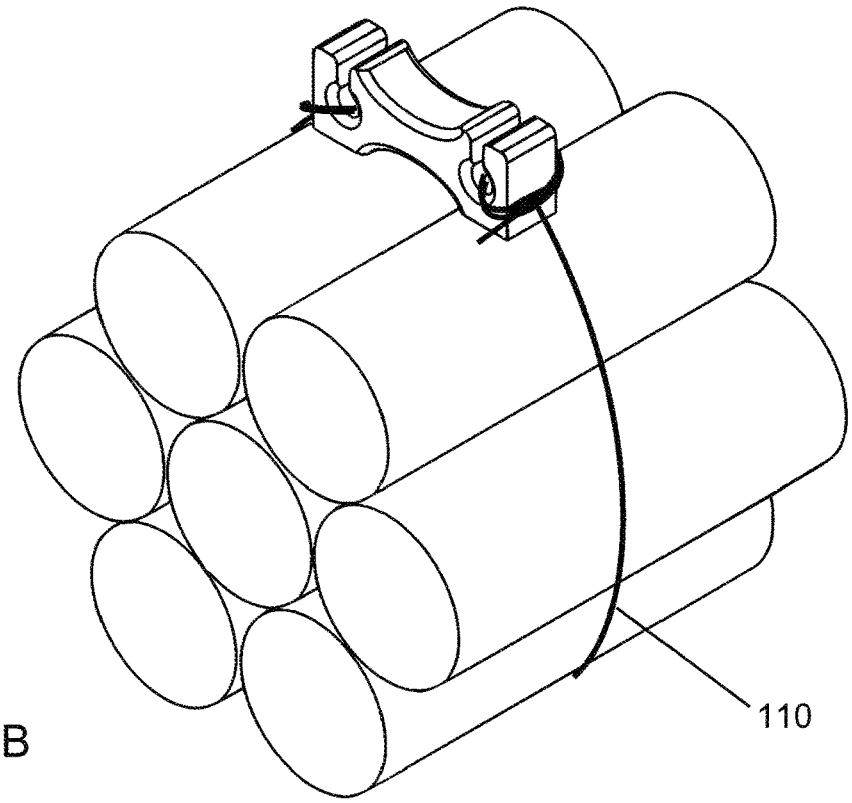
FIG. 2B is a perspective view of the embodiment depicted in FIG. 1A in combination with a open-loop tensile line and objects in accordance with principles disclosed herein.

Referring to FIG. 2A, an embodiment of the coupling article is used to bundle objects 200 by coupling at least two portions of the closed-loop tensile line 100. This is achieved by simply sliding a portion of the closed-loop tensile line 100 through the passage means, in the form of channel 320, into the cutout, in the form of bore 310, of a first end section 330. The closed-loop tensile line 100 is then wrapped around the objects one or more times based on the desired tension, strength and length of the closed-loop tensile line. When the wrapping is complete, the user slides a remaining portion of the closed-loop tensile line 100 through the channel 320 into bore 310 of a second end section 330. As shown in FIG. 2B, an embodiment of the coupling article is used to bundle objects 200, in combination with a open-loop tensile line 110, by wrapping a first end portion of the open-loop tensile line around a first end section 330 within the corresponding cutout having the form of bore 310, and securing with a knot. The remaining portion open-loop tensile line 110 is then wrapped around the objects and secured to a second end section 330 in the same manner as was secured by the first end section.

To extend the overall securing length, two or more closed-loop tensile lines are joined together using a pull through or other suitable type of knot, and then secured at the ends by employing the coupling article as previously stated. The overall wrapping length can also be extended by using the coupling article to couple one closed-loop tensile line to the next instead of using knots to connect the intermediate closed-loop tensile lines. Additionally, to increase the holding tension of a bundle, at least one extra tensile line can be used to 'rebundle' the objects by overlapping the existing tensile line or set of tensile lines containing the objects.

The following advantages become evident from the use and operation of the coupling article as previously described:

1. The user may select the size best suited for the bundling application, and easily employ two or more coupling articles to accommodate any circumference a bundle may have.
2. Connecting closed-loop tensile lines with the coupling article is easy so the user can bundle items quickly.
3. The user can readily increase the binding tension for greater bundling security since the coupling article easily accommodates the use of more than one tensile line.
4. When the coupling article engages a closed-loop tensile line, the coupling is inherently secure so the contents of the bundle remain clinched when handled.
5. The user can easily remove the coupling article for replacement or to reorganize the bundle.
6. The design of the coupling article supports the simple but secure use of coupling one tensile line to the next to achieve any overall desired length for bundling.

7. The simple design of the coupling article, having no movable parts, requires minimal machining therefore making it inexpensive to manufacture allowing the coupling article to be priced at a favorable cost for use and replacement.

8. An end section of the coupling article can retain a portion of a closed-loop tensile line without tension so the coupling article can easily be store with the closed-loop tensile line.

9. The coupling article can be used in conjunction with an open-loop tensile line by wrapping end portions of the open-loop tensile line around end sections of the coupling article and securing with a knot.

The above discussion is meant to be illustrative of various embodiments of the present invention. Numerous variations and modifications will become apparent to those skilled in the art once the above disclosure is fully appreciated. It is intended that the following claims be interpreted to embrace all such variations and modifications.

What is claimed is:

1. A coupling article used in conjunction with a tensile line to facilitate the bundling of one or more objects, comprising:

at least one elongate body having a concavity along the greater portion of at least one side thereof, said concavity having a width equal to that of the side of said elongate body to which it is applied defining a D-shaped void; and at least one pair of end sections consisting of a first end section and a second end section each having a cutout located therethrough and each having a passage means contiguous to said cutout, said passage means cooperates with said cutout to allow said tensile line to either enter or exit said cutout, said pair of end sections is thereby configured to releasably and slideably retain at least one portion of a closed-loop tensile line therewith, and further configured to releasably secure at least one portion of an open-loop tensile line therewith, said pair of end sections being separated in an opposing manner by said elongate body and connected integrally thereto such that an extending longitudinal midline of said elongate body intersects the approximate center of said cutout;

whereby a user can releasably and slideably engage at least a first portion of said closed-loop tensile line using said first end section, wrap an unengaged portion of said closed-loop tensile line around said one or more objects at least one time, and use said second end section to releasably and slideably engage at least a first remaining portion of said closed-loop tensile line thereby bundling said one or more objects; furthermore, a user can releasably affix a first part of said open-loop tensile line to said first end section by securing with a knot, wrap an unsecured portion of said open-loop tensile line around said one or more objects at least one time, and releasably affix a second part of said open-loop tensile line to said second end section by securing with a knot thereby bundling said one or more objects.

2. The coupling article of claim 1 wherein intersecting surfaces have a fillet or chamfer applied to the edges thereof.

3. The coupling article of claim 1 wherein said cutout is shaped in the form of a bore and sized to accommodate one or more of said tensile lines or portions thereof.

4. The coupling article of claim 1 wherein said cutout is shaped in the form of a straight slot and sized to accommodate one or more of said tensile lines or portions thereof.

5. The coupling article of claim 1 wherein said cutout is shaped in the form of an "S" fashioned slot and sized to accommodate one or more of said tensile lines or portions thereof.

6. The coupling article of claim 1 wherein surface boundaries of said passage means and surface boundaries of said cutout have a fillet or chamfer applied to the edges thereof.

7. The coupling article of claim 1 wherein said passage means is shaped in the form of a straight channel sized to allow said tensile line to either enter or exit said cutout with slight resistance or an absence thereof.

8. The coupling article of claim 1 wherein said passage means is shaped in the form of a curved channel sized to allow said tensile line to either enter or exit said cutout with slight resistance or an absence thereof.

9. The coupling article of claim 1 wherein said passage means and said cutout are combined into a substantially integrated shape sized to accommodate one or more of said tensile lines.

10. The coupling article of claim 1 wherein said elongate body includes said concavity along a first side and a second side thereof, said first side is located on the side opposite to that of said passage means and said second side is located on the side opposite to that of said first side.

11. The coupling article of claim 1 further comprising a first said elongate body and a second said elongate body intersecting integrally at their respective midplanes whereby a user can bundle said one or more objects in a criss-cross like fashion.

* * * * *